US006815918B2

(12) United States Patent
Porat et al.

(10) Patent No.: US 6,815,918 B2
(45) Date of Patent: Nov. 9, 2004

(54) POOL CLEANING METHOD AND APPARATUS

(75) Inventors: Joseph Porat, North Caldwell, NJ (US); Igor Fridman, Natanya (IL)

(73) Assignee: Aqua Products Inc., Cedar Grove, NJ (US)

( * ) Notice: Subject to any disclaimer, the term of this patent is extended or adjusted under 35 U.S.C. 154(b) by 9 days.

(21) Appl. No.: 10/209,164

(22) Filed: Jul. 30, 2002

(65) Prior Publication Data

US 2004/0021439 A1 Feb. 5, 2004

Related U.S. Application Data

(63) Continuation-in-part of application No. 10/188,466, filed on Jul. 2, 2002, now abandoned.

(30) Foreign Application Priority Data

Oct. 15, 2001 (IL) ..... 145930

(51) Int. Cl.[7] ..... B01D 33/80; B08B 13/00

(52) U.S. Cl. ..... 318/568.12; 318/162; 318/558; 901/1; 15/1.7; 210/169; 210/416.2

(58) Field of Search ..... 318/568.11, 568.12, 318/568.13, 588, 114, 159, 162, 372, 558; 901/1; 15/1.7; 210/143, 167, 169, 416.1, 416.2

(56) References Cited

U.S. PATENT DOCUMENTS 5,337,434 A * 8/1994 Erlich ..... 15/1.7
5,569,371 A * 10/1996 Perling ..... 210/85
5,771,987 A * 6/1998 Marbach ..... 180/6.66
6,099,658 A * 8/2000 Porat ..... 134/18
6,155,657 A * 12/2000 Erlich et al. ..... 305/178

* cited by examiner

*Primary Examiner*—Bentsu Ro
(74) *Attorney, Agent, or Firm*—Abelman, Frayne & Schwab

(57) ABSTRACT

A method for cleaning the bottom of a pool uses an automated programmed pool cleaner capable of reversing movement and turning that is initially placed at an arbitrary location on the bottom of the pool and moved in a forward direction until it encounters an upright pool wall; the unit is reversed until it is a first predetermined distance from the wall, turned through a predetermined angle less than 180° and advanced until it again encounters an upright wall; these steps are repeated until the unit has encountered upright walls a predetermined number of times, after which the first predetermined distance is changed to one or more subsequent predetermined distances. All of the previous steps are repeated until all or substantially all of the pool has been cleaned. In a preferred embodiment, a rectangular pool is cleaned by setting the turning angle to 90° and the number of turns before changing the predetermined distance to seven. In another aspect of the invention, the unit has a rotary impeller driven in a horizontal plane, and the robot is turned by interrupting motive force to the impeller a plurality of times during a predetermined period of time to create a sufficient torque or torsional force to rotate the nearly neutrally buoyant unit through the desired turning angle.

29 Claims, 5 Drawing Sheets

POOL CLEANING METHOD AND APPARATUS

This application is a continuation-in-part of application Ser. No. 10/188,466 filed Jul. 2, 2002, now abandoned.

FIELD OF THE INVENTION

The present invention relates to pool cleaning robots. More particularly it relates to apparatus and method for cleaning the bottom of a pool.

BACKGROUND OF THE INVENTION

There are many types of automatic pool cleaners available, exhibiting various navigational abilities and ways of cleaning the bottom of a pool.

For example, in U.S. Pat. No. 6,125,492 (Prowse), titled Automatic Swimming Pool Cleaning Device, there was disclosed an automatic swimming pool cleaning device, which includes a flexible cleaning member designed to contact an underwater surface of the swimming pool. A tube is coupled to the cleaning member for connecting the cleaning device to a water vacuum hose via hose adaptor. Water and pool surface contamination is drawn from underneath the cleaning member up through the tube by suction to a water filter system before being returned to the pool. A flexible valve member is mounted proximate a throat region of the tube wherein as water is drawn up through the tube a decrease in pressure in the throat region causes the valve member to flex and momentarily interrupt the flow of water. The interruption to the flow of water through the tube results in a momentary differential of ambient pressure underneath the flexible cleaning member which enables the device to move forwards incrementally along the underwater surface of the pool.

U.S. Pat. No. 6,099,658 (Porat), titled Apparatus and Method of Operation for High-Speed Swimming Pool Cleaner disclosed an apparatus and method for cleaning the bottom and vertical side walls of a swimming pool, pond or tank employing a robotic, self-propelled cleaner. The robot has a protective housing of conventional design, the cleaner being operated at a primary cleaning speed as it traverses the surfaces to be cleaned and until the cleaner housing emerges from the water along a sidewall of the pool; thereafter the cleaner operates at a secondary drive speed that is relatively slower than the primary speed and the cleaner thereafter reverses direction and descends for a pre-determined period of time at the slower secondary speed in order to permit the air entrained under the housing to escape without destabilizing the cleaner during descent. After the predetermined period of time, the cleaner resumes operation at the more rapid primary speed until the cleaner housing once again emerges from the water's surface, after which the cycle is repeated.

In U.S. Pat. No. 5,086,535 (Grossmeyer et al.) titled Machine and Method Using Graphic Data for Treating A Surface, there was disclosed a machine for treating a surface area within a boundary perimeter includes a self propelled chassis having a surface treating device mounted on it. A computing section is mounted on the chassis and a powered wheel (or each of plural powered wheels) has a motor module for receiving command signals from the computing section. A position sensor is coupled to the computing section for generating a feedback signal representing the actual position of the machine. A data loading device coacts with the computing section for transmitting data to such computing section. A data file stores graphic data developed from a graphic depiction representing the surface area to be treated as well as other data developed in other ways. The data file coacts with the computing section and transmits graphic and other data to it. The computing section is arranged for processing the data and the feedback signal and responsively generating command signals directed to each motor module. Such modules, and the motors controlled thereby, propel the machine over the surface area selected to be treated.

U.S. Pat. No. 5,569,371 (Perling) titled System For Underwater Navigation and Control of Mobile Swimming Pool Filter, disclosed an underwater navigation and control system for a swimming pool cleaning robot, having a driver, an impeller, a filter and a processor for controlling the driver and a signal-producing circuit. The system further includes a signal-detecting circuit mounted on the pool, an interface located on the ground in proximity to the pool and comprising a detector for receiving and processing data from the detecting circuit and for transmitting signals to the robot's processor. Determination of the actual robot location is performed by triangulation in which the stationary triangulation base is defined by at least two spaced-apart signal detectors and the mobile triangle apex is constituted by the signal-producing circuit carried by the robot.

U.S. Pat. No. 5,197,158 (Moini) titled Swimming Pool Cleaner, disclosed a vacuum powered automatic swimming pool cleaning device having a hollow housing supported on two pairs of device mover wheels. The housing includes a central water suction chamber in water flow communication with a water suction trough at the bottom of the housing and in water outlet communication with an external vacuum line, a gear train for driving one of the pairs of mover wheels, and pivoted directional control floats. The water suction chamber houses an axle mounted turbine wheel bearing water driven vanes with the turbine being rotated in one direction only by water flow through the chamber. The turbine axle bears a turbine power output drive gear which intermeshes with one or the other of two shift gears which in turn reversibly drive the gear train as dictated by the position of the directional control floats within the housing. The floats swing shift within the housing to shift the shift gears in response to the impact of the cleaning device on an obstruction on the pool floor or by the device impacting a vertical pool wall. The swing shift of the control floats reverses the rotation of the mover wheels and thus the direction of movement of the cleaning device on the pool floor.

U.S. Pat. No. 4,786,334 (Nystrom) titled Method of Cleaning the Bottom of a Pool, disclosed a method of cleaning the bottom of a pool with the aid of a pool cleaner. The pool cleaner travels along the bottom of the pool and collects material lying at the bottom of the pool. The pool cleaner is arranged to travel to and fro in straight, parallel paths between two opposite walls of the pool. At the walls the pool cleaner is turned by rotating a half turn so that, after turning, it will have been displaced laterally perpendicular to the initial direction of travel.

In U.S. Pat. No. 4,593,239 (Yamamoto) titled Method and Apparatus for Controlling Travel of an Automatic Guided Vehicle, there was disclosed an automatic guided vehicle detects marks located on a plurality of points along a route it travels using at least three sensors, selects the number of marks detected from each individual sensor as a reference value in accordance with the logic of majority, and stops when the reference value agrees with a predetermined value. Cumulative errors, caused by misdetection are thus avoided and, there is little cumulative error.

U.S. Pat. No. 4,700,427 (Kneppers), titled Method of Automatically Steering Self-Propelled Floor-Cleaning Machines and Floor-Cleaning Machine for Practicing the Method, disclosed a method of automatically steering a self-propelled floor-cleaning machine along a predetermined path of motion on a limited area to be worked. A sequence of path segments stored in a data memory is retrieved, and the path segments travelled by the machine. Markings are recognized by at least one sensor and converted into course-correcting control commands actuating and/or steering the machine.

U.S. Pat. No. 3,979,788 (Strausak) titled mobile machine for cleaning swimming pools, disclosed a Mobile Machine for Cleaning Swimming Pools by suction removal of sediment from the bottom of the swimming pools comprises a water turbine driving a drive wheel in such a way that the machine follows a self-steered path on the bottom of the swimming pools. The drive wheel is capable of rotating about a vertical steering axle to prevent the machine from becoming blocked at a wall or in a corner of the swimming pools.

It is noted that covering efficiently and quickly the bottom (and side walls) of a swimming pool is not simple a task, and various scanning algorithms (see some of the above-mentioned patents for examples) were devised to try and overcome this complex problem. Contributing to the complexity of the navigational problem is the fact that even though a robot is generally programmed to travel in straight lines from side to side and take accurate turns, it is difficult to keep it on such path and turns are hard to direct accurately. In fact a travel pattern of a pool cleaning robot is more likely to be deviated as the robot is subjected to different conditions and forces such as its own weight, the pull and weight of its electric cord, underwater currents, different friction forces due to uneven surface elevation or texture, dirt on floor, asymmetrically (or even amorphically) shaped pools etc. Consequently all navigational algorithms of pool cleaning robots depend on numerous and even repeated cycles of sweeping in order to achieve substantial coverage of the pool.

When irregularly-shaped pools are considered, some sweeping algorithms appear to be inadequate and fail to substantially cover the pool's floor.

It is the purpose of the present invention to provide a novel and improved method for navigating a pool cleaning robot on the bottom and side walls of a pool and an apparatus thereof.

Yet another purpose of the present invention to provide a method and an apparatus for navigating a pool cleaning robot that allow efficient and fast cleaning of the bottom and side walls of a pool.

Still another aim of the present invention is to provide such method and apparatus that allow high performance and coverage in cleaning irregularly shaped pools.

Other advantages and aspects of the present invention will become apparent after reading the present specification and viewing the accompanying drawings.

BRIEF DESCRIPTION OF THE INVENTION

It is therefore thus provided, in accordance with a preferred embodiment of the present invention, a method for sweeping the floor of a pool by a pool cleaning robot initially set at an arbitrary position on the floor of the pool, the method comprising:

advancing the robot to until it encounters a wall;

reversing the robot and advancing it away from the wall, allowing the robot to travel a leg of predetermined distance;

turning the robot sideways in a predetermined angle of turn;

repeating the above steps until a predetermined number of wall encounters was counted, after which the predetermined distance of the leg is altered; and repeating the above steps whereby a substantial area of the floor is covered by the robot.

Furthermore, in accordance with another preferred embodiment of the present invention, the predetermined angle of turn varies in some turns during the sweeping of the floor.

Furthermore, in accordance with another preferred embodiment of the present invention, the robot is initially positioned near a side end of the wall.

Furthermore, in accordance with another preferred embodiment of the present invention, the robot is initially positioned within a distance of 1 to 3 times the width of the robot from the side end of the wall.

Furthermore, in accordance with another preferred embodiment of the present invention, the angle of turn is substantially a right angle turn.

Furthermore, in accordance with another preferred embodiment of the present invention, the robot is turned in an angle of turn positioning the robot in a perpendicular direction to a facing wall.

Furthermore, in accordance with another preferred embodiment of the present invention, the alteration of the predetermined distance of the leg consists of increasing the length.

Furthermore, in accordance with another preferred embodiment of the present invention, the length of the leg is increased up to about half the length of the pool.

Furthermore, in accordance with another preferred embodiment of the present invention, the alteration of the predetermined distance of the leg consists of decreasing the length.

Furthermore, in accordance with another preferred embodiment of the present invention, the initial position of the robot at the commencing of the sweeping of the pool is about half way across the wall.

Furthermore, in accordance with another preferred embodiment of the present invention, the turn is taken constantly to the right with respect to the traveling robot.

Furthermore, in accordance with another preferred embodiment of the present invention, the turn is taken constantly to the left with respect to the traveling robot.

Furthermore, in accordance with another preferred embodiment of the present invention, the predetermined number of wall encounters counted prior to alteration of the length of the leg is 7.

Furthermore, in accordance with another preferred embodiment of the present invention, the alteration of the length of the leg is done in steps of constant lengths.

Furthermore, in accordance with another preferred embodiment of the present invention, the robot is a single motor driven robot having a powered horizontal impeller, and wherein the robot is turned by applying at least one of a plurality of predetermined number of interrupts in the impeller power thus causing the robot to acquire bias momentum directed sideways and hence move in the direction of the bias.

Furthermore, in accordance with another preferred embodiment of the present invention, the predetermined number of interrupts is between 15 to 25.

Furthermore, in accordance with another preferred embodiment of the present invention, the duration of the series of predetermined number of interrupts is in the range of about 10 to 20 seconds.

Furthermore, in accordance with another preferred embodiment of the present invention, each interrupt lasts about 0.5 to 0.8 seconds.

Furthermore, in accordance with another preferred embodiment of the present invention, there is provided a method for turning sideways a pool cleaning robot having a single motor drive and a powered horizontal impeller, the method comprising applying at least one of a plurality of predetermined number of interrupts in the impeller power thus causing the robot to acquire bias momentum directed sideways and hence move in the direction of the bias.

Furthermore, in accordance with another preferred embodiment of the present invention, there is provided a pool cleaning robot comprising:

a reversible motorized drive;

an impeller driven by a pump motor;

a power supply;

a processor for counting wall encounters and including a programmed algorithm for navigating and operating, the algorithm comprising the following steps:

advancing the robot to until it encounters a wall;

reversing the robot and advancing it away from the wall, allowing the robot to travel a leg of predetermined distance;

turning the robot sideways in a predetermined angle of turn;

repeating the above steps until a predetermined number of wall encounters was counted, after which the predetermined distance of the leg is altered; and repeating the above steps whereby substantial area of the floor is covered by the robot;

a controller for receiving commands from the processor and reversing the robot and initiating turning of the robot upon the appropriate commands from the processor; and a wall encounter sensor for sensing a wall encounter and sending a signal to the processor.

Furthermore, in accordance with another preferred embodiment of the present invention, the wall encounter sensor comprises a proximity sensor or a collision sensor or a tilt sensor or a sonar sensor.

Furthermore, in accordance with another preferred embodiment of the present invention, the reversible motorized drive is a reversible motorized caterpillar drive.

Furthermore, in accordance with another preferred embodiment of the present invention, the robot further comprises a GPS receiver for determining its position and direction.

Furthermore, in accordance with another preferred embodiment of the present invention, there is provided a pool cleaning robot comprising:

a reversible motorized drive;

an impeller driven by a pump motor;

power supply;

processor having a programmed algorithm for navigating and operating the robot, the algorithm includes inter alia applying at least one of a plurality of predetermined number of interrupts in the impeller power thus causing the robot to acquire bias momentum directed sideways and hence move in the direction of the bias;

controller for receiving commands from the processor and reversing the robot and initiating turning of the robot upon the appropriate commands from the processor.

BRIEF DESCRIPTION OF THE DRAWINGS

In order to better understand the present invention, and appreciate its practical applications, the following Figures are provided and referenced hereafter. It should be noted that the Figures are given as examples only and in no way limit the scope of the invention as defined in the appending claims. Like components are denoted by like reference numerals.

DETAILED DESCRIPTION OF THE INVENTION

A main aspect of the present invention is the navigation algorithm disclosed in the present invention that introduces a systematic sweep of the bottom of the pool in a predetermined manner.

Another main aspect of the present invention is the provision of a pool-cleaning robot with a novel and unique steering mechanism exploiting imparted changes in the angular momentum of an impeller in the robot.

The sweeping of the pool's bottom is carried out by making the pool cleaning robot follow a series of paths across the bottom of the pool, from one side of the pool to the opposite side. After each crossing the robot reverses, traveling a leg (or step) of predetermined distance back, substantially on its previous track and then turns sideways in a predetermined angle of turn and the robot moves on to reach the wall, reverse and cross from that wall to the opposite wall. Each time the robot encounters a wall it senses this event and counts the number of wall encounters. After a predetermined number of wall encounters was counted, the predetermined distance of the leg is altered and the routine is continues until the entire area of the bottom of the pool was covered.

Figure 1:
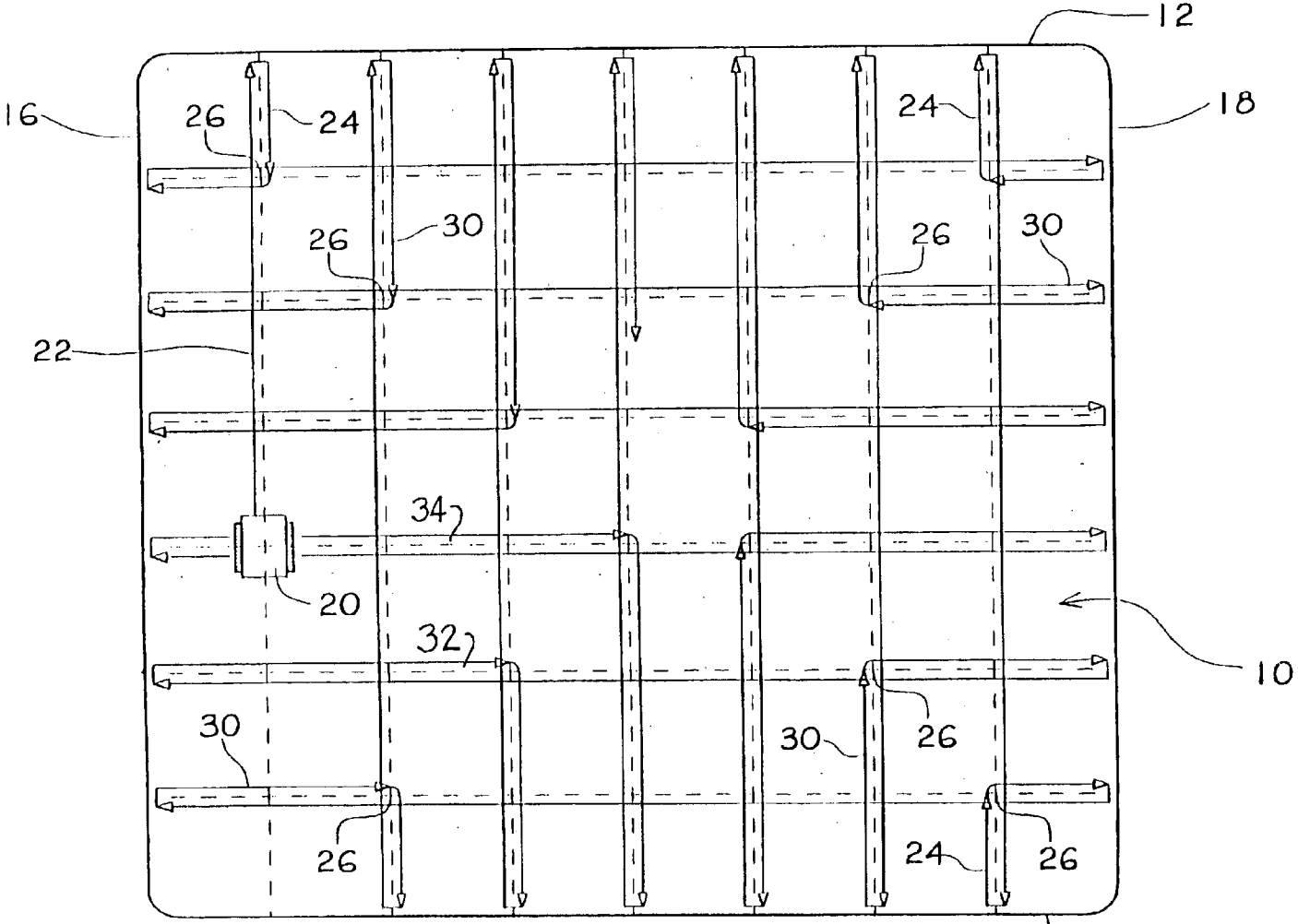
FIG. 1 illustrates the path traveled by a pool cleaning robot in accordance with a preferred embodiment of the present invention.

Reference is now made to FIG. 1, illustrating an example of a path traveled by a pool cleaning robot in accordance with a preferred embodiment of the present invention. It is noted that the lines with the arrowheads represent the direction of travel by the robot, and in order to show clearly the direction of travel do not over lap, although in fact it is anticipated that the robot will follow its tracks on its reverse course. The dashed line represents the actual path on which the robot is supposed to travel.

A pool's rectangular floor 10 is shown, with four surrounding walls arranged in two pairs of parallel opposite walls (12, 14, 16, 18).

In a preferred embodiment of the present invention the method of systematically sweeping the pool's floor is as follows: a pool cleaning robot 20, typically having a motor-driven caterpillar drive (but other drive types are possible too), is initially set to start crossing in a straight path 22 on the pool's floor 10, commencing its trip at the side of the pool adjacent wall 14. The initial position may be chosen arbitrarily, even somewhere in the middle of the pool. In polygonal pools, such as the rectangular pool shown in FIG. 1, it is recommended to position the robot initially near one side end of the wall (preferably within a distance of 1 to 3 times the width of the robot), bearing in mind the effective cleaning area covered by the robot as its pumps dirt and foliage. By "side end of the wall" it is meant one of the ends of a wall on either side, as opposed to its top and bottom ends.

The robot 20 crosses over to the other side of the pool, traveling in a substantially straight line 22 on the floor 10 until it encounters wall 12. Once the robot has encountered a wall the motor drive is reversed, and the robot is driven in substantially the opposite direction. After a leg of predetermined length 24 was traveled, the robot is turned sideways in a predetermined angle 26 (substantially at right angle in the example of FIG. 1) and then travels substantially straight until a wall 16 is encountered. For polygonal pools turns it is recommended to aim at making the turn angle such that the robot then traverses perpendicular to a facing wall of the pool, but that is not a compulsory requirement.

As seen in FIG. 1, upon the robot encountering the wall 16 the drive motor is again reversed, and the robot travels the width of the pool where it encounters the opposing side wall 18, after which the motor is again reversed. After traveling another leg of predetermined length 24, the robot is again turned sideways in a predetermined angle 26 and directed to the wall 12 of the pool.

After a predetermined number of wall encounters the length of the leg is altered to a new length of leg 30 (and then 32, 34), thus substantially preventing the robot from following the same path it has previously taken, hence and enhancing its coverage of the pool's floor. Preferably after alteration of the length of the leg the counter is reset and starts counting wall encounters until the same number of predetermined wall encounters was counted, upon which the length of the leg is again altered.

The alteration of the length of the leg traveled by the robot after it was reversed upon encountering a wall may consist of either increasing or decreasing the length. In the example shown in FIG. 1, the leg length is increased. It is possible to set the leg length to be decreased instead of increased. In such a case the initial position of the robot at the commencing of the sweeping of the pool is preferably about half way across the wall at the side.

It is noted that if the algorithm involves increasing the length of the leg it is enough to increase it up to about half of the anticipated length of the pool, for after that any further increase would result in the robot traveling on a path previously taken. This is not an ultimate requirement as the user may decide to end the sweeping of the pool's floor by the robot at any instant. It is possible to time the robot's operation using a timer switch, thus limiting its travel in that way.

The turn may be taken in any direction (i.e. right or left), but preferably same direction of turn is taken throughout the sweeping procedure to ensure efficient coverage of the pool's floor.

For a rectangular pool as shown in FIG. 1, the predetermined number of wall encounters counted prior to alteration of the length of the leg is preferably 7, for if the length of the leg is not altered after 7 wall encounters the robot may be found traveling substantially on its previous tracks following the same initial path 22.

The varying length of the leg traveled by the robot after it was reversed upon encountering a wall may be set arbitrarily. In the example exhibited in FIG. 1, the length is increased at steps of constant lengths, but that is not imperative.

The predetermined angle of turn may also vary in some turns—or all of them—during the sweeping process, either in a predetermined manner (such as programmed in advance) or arbitrarily.

A pool cleaning robot in accordance with a preferred embodiment of the present invention may be any such robot adapted to perform the steering algorithm of the present invention.

Figure 2A:
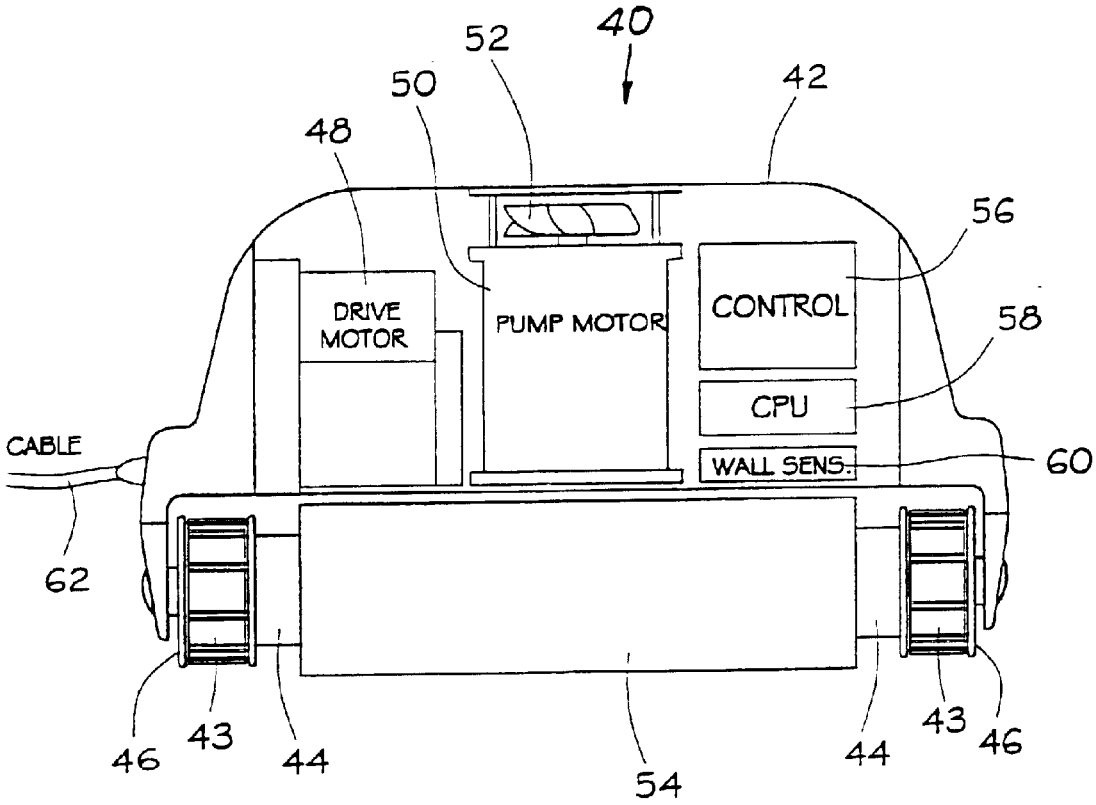
FIG. 2*a* illustrates a sectional view of a pool cleaning robot in accordance with the present invention.

Reference is now made to FIG. 2*a* illustrating a sectional view of a pool cleaning robot 40 in accordance with the present invention. A robot housing 42 houses a motor drive 48 for driving the axles 44 (in axle cover 54) on which ends wheels 46 are attached to the caterpillar tracks, an impeller 52 oriented horizontally (to pump water from the pool's floor upwards into the robot), driven by a pump motor 50, control unit 56, central processing unit (CPU) 58 and wall encounter sensor 60. The pumped dirt and foliage are collected inside a filter bag that is positioned inside the housing along the pump. Power cable 62 goes through the housing 42 to provide power to the robot electric components. In other preferred embodiments of the present invention no power cable is provided and instead the robot is powered by battery.

Figure 2B:
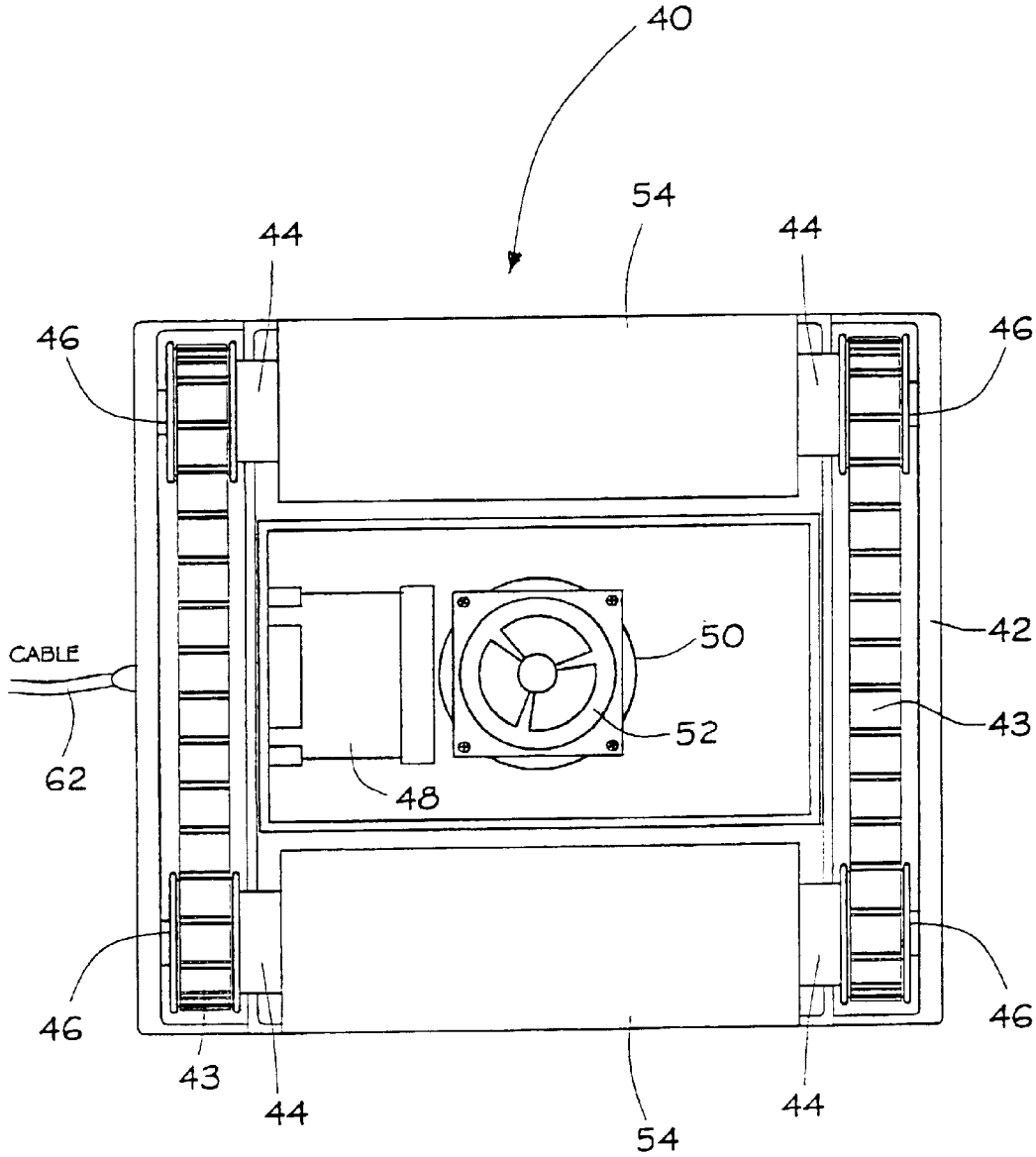
FIG. 2*b* illustrates the bottom view of a pool cleaning robot in accordance with the present invention.

FIG. 2*b* illustrates the bottom view of a pool cleaning robot in accordance with the present invention. Twin parallel caterpillar tracks 43 are provided, stretched over and motivated by wheels 46.

The robot shown in FIGS. 2*a* and 2*b* is driven by a single motor (drive motor 48). Usually pool cleaning robots targeted for small and medium sized pools are provided with a single motor drive, whereas for twin motor drive is popular in large pools cleaning robots. Single motor drive can be reversed by employing provided transmission to reverse the direction of the rotation of the wheel axles, but it cannot be used to turn the robot sideways. It takes two separate motors to maneuver sideways, as each track is operated separately, either by stopping one track and driving the other, or by pirouetting (driving tracks in opposite directions). In order to make a single motor robot turn sideways it is suggested to employ a series of intentional interrupts in the impeller rotation thus causing the robot to acquire bias momentum directed sideways and hence move in that direction. This method takes advantage of the fact that impellers are inherently biased and it was found by the inventor of the present invention that a series imparted interrupts in the impeller rotation cause the robot to acquire momentum directed sideways.

The number of interrupts—which may vary from a single interrupt to a series of interrupts, as well as their cycle and duration are empirically found for every robot, and depend on factors such as the robot weight, type, type of pump, size, weight and rotational velocity of the impeller, speed of robot when driven on its caterpillar tracks, the desired angle of turn etc.

It was found that for a pool cleaning robot whose weight is 10.5 kg, with a brushless drive motor and pump that work on DC 12 Volt, 18 m floating cable and a transformer (commercially available from Tematech Ltd., Afula, Israel, under the brand name "Aquabot" type "Bravo"), in order to turn in substantially right angle, a series of impeller interrupts is applied with the following parameters: the interrupt series duration was about 10 to 20 seconds, during which a series of about 15 to 25 interrupts in the impeller's operation were administered (by switching the impeller power off and on sequentially), each interrupt lasting about 0.5 to 0.8 seconds. Again it is emphasized that these parameters are empirical and differ from robot to robot depending on its specific characteristics and features, as explained hereinabove.

Figure 3:
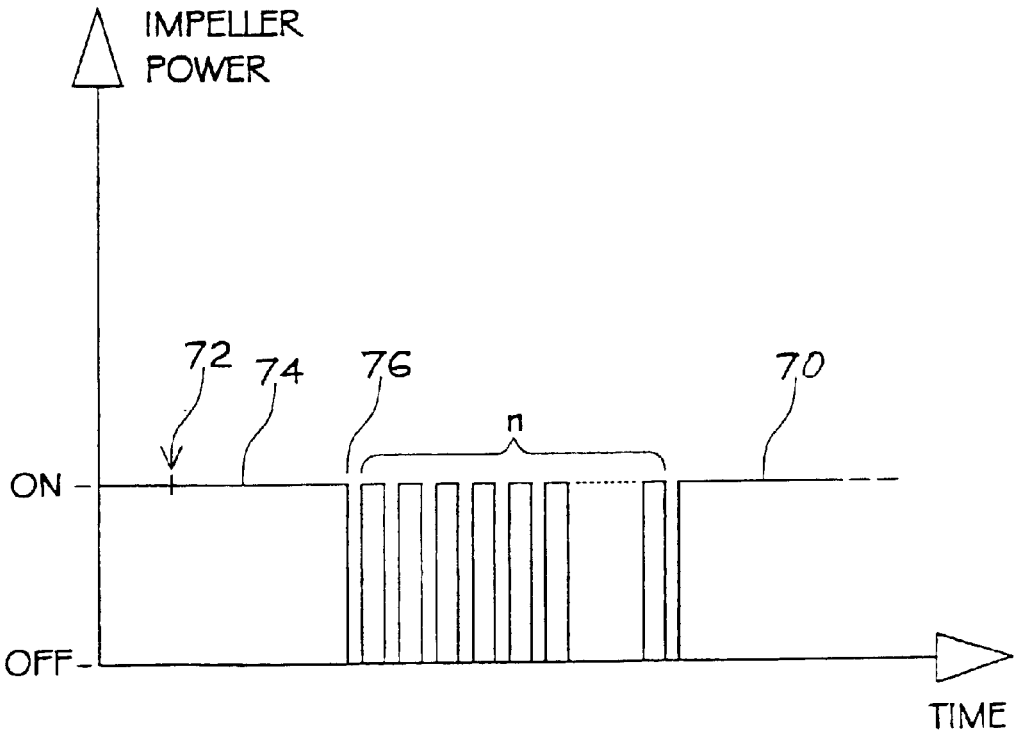
FIG. 3 illustrates a plot of the impeller power versus time before, during and after a turn maneuver.

FIG. 3 illustrates a plot of the impeller power versus time before, during and after a turn maneuver. The X axis represents time and the Y axis represents the power status of the impeller. Portion 70 of the plot represents the power of the impeller as the robot with its impeller power on approaches a wall. At instance 72 the robot detects wall encounter and its drive is reversed. It then travels a leg of predetermined length during time duration 74 (the length is easily determined as being the product of the robots known speed by a predetermined time duration). Once the length of the leg has been reached (instance 76) a series of n interrupts in the power supplied to the impeller are administered in predetermined cycle and duration. Once turned the power of the impeller remains on until the next turn maneuver.

It is important to note that the sweeping method of the present invention (such as the example shown in FIG. 1) is independent of the navigational nature of the pool cleaning robots, and certainly not limited to single motor robots in general or to single motor robots maneuvered using the interrupted impeller rotation as disclosed herein. Other types of pool cleaning robots navigated in various navigation methods, such as GPS or others are all covered by the scope of this invention.

Figure 4:
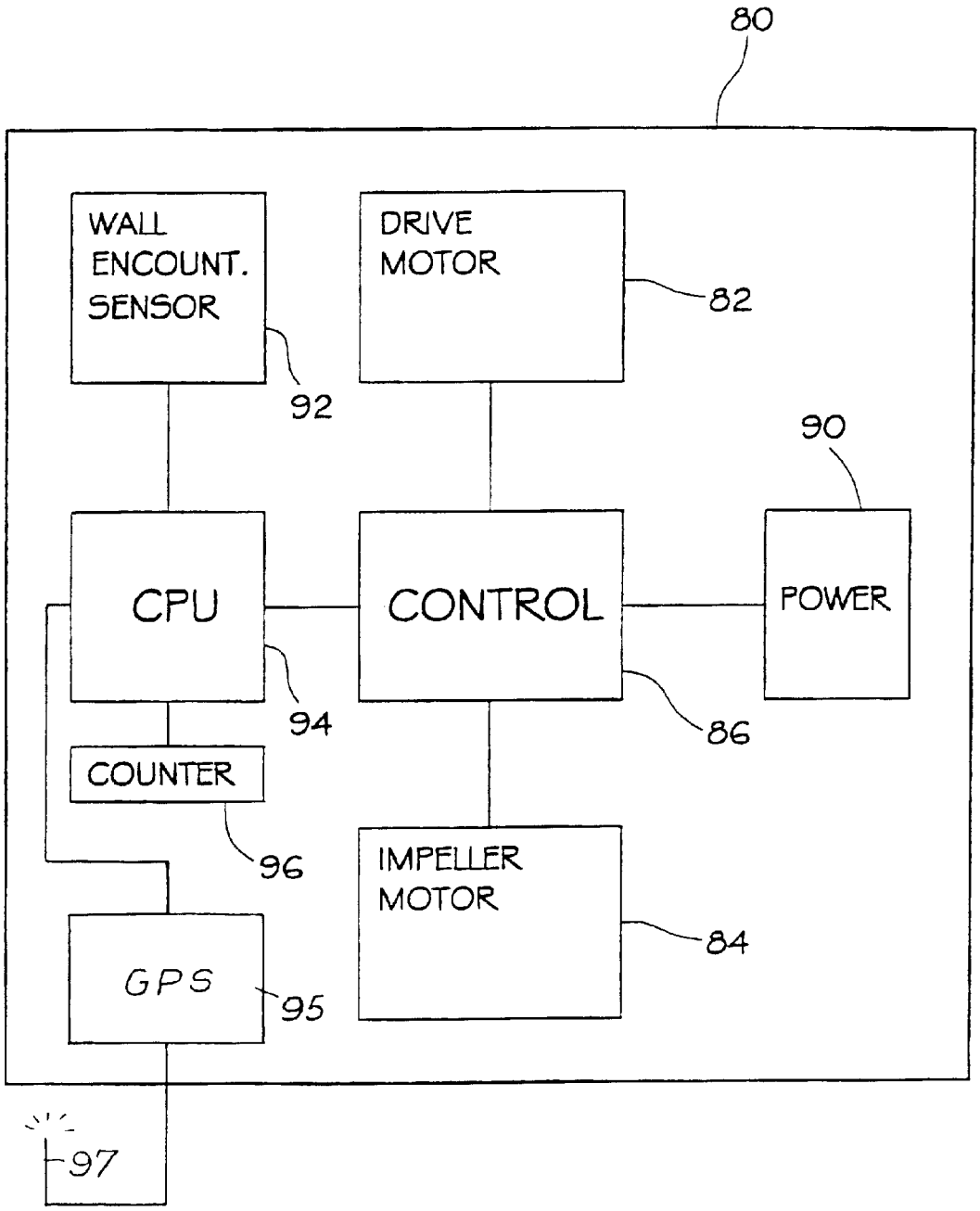
FIG. 4 illustrates a schematic diagram of the electric features of a pool cleaning robot in accordance with the present invention.

FIG. 4 illustrates a schematic diagram of the electric features of a pool cleaning robot 80 in accordance with the present invention. Powered by power supply 90, either externally (through a cable) or internally (battery) the pool cleaning robot comprises a reversible drive motor 82 and impeller motor 84 independently controlled by a control unit 86. The control unit is connected to a processing unit (CPU) 94 that dictates the operation of the control and consequently of the entire robot. The robot has a wall encounter sensor 92 that senses a wall encounter and generates a signal that is received by the processing unit. It is noted that the event of encountering a wall may be sensed by a sensor provided on the robot, such as a proximity sensor or collision sensor, or sonar sensor, and the drive motor of the robot is switched to the reverse direction. For example, for that purpose a proximity sensor—an optical sensor typically operating in the infrared range—or a tilt sensor, such as mercury sensor—a sensor actuated by a balanced tiltable mechanism that senses the tilting of the robot as it attempts to climb a wall, may be used. If a sonar sensor is used one can obtain better direction control too.

The processing unit is programmed to actuate the drive motor and impeller motor, via the control unit, in a predetermined manner following an algorithm such as explained with reference to FIG. 1 and FIG. 3, switching the drive motor between forward and reverse modes, and applying the interrupt sequences scheme to the impeller motor.

An optional GPS receiver 95 communicating with the CPU may be incorporated in the robot to allow determining its position and direction. The GPS is provided with a floating antenna 97 or an antenna is incorporated in the power cable from the remote power supply unit.

The events of wall encounters are counted by a counter 96 incorporated with a central processing unit of the robot.

It is noted that the method and apparatus for automated pool cleaning of the present invention may be implemented on pools of any shapes, whether rectangular, polygonal, circular, oval and even irregularly shaped ones. The step of varying the length of the legs of the present invention ensures that substantially the entire pool floor be efficiently covered and thereby cleaned in a relatively short time.

The apparatus and method for pool cleaning robot of the present invention allow covering efficiently and relatively quickly the bottom of a pool of any shape, depth and size.

It should be clear that the description of the embodiments and attached Figures set forth in this specification serves only for a better understanding of the invention, without limiting its scope as covered by the following claims.

It should also be clear that a person skilled in the art, after reading the present specification could make adjustments or amendments to the attached Figures and above described embodiments that would still be covered by the following claims.

What is claimed is:

1. A method for cleaning the bottom surface of a pool using a robotic pool cleaner capable of movement in a forward direction and a reverse direction, the pool cleaner initially placed at an arbitrary location on the pool surface, the method comprising the steps of:

moving the pool cleaner in the forward direction until it encounters an upright wall of the pool;

moving the pool cleaner in the reverse direction until it reaches a predetermined distance from the upright wall;

turning the pool cleaner through a predetermined angle less than 180°;

moving the pool cleaner in the reverse direction until it encounters an upright wall of the pool;

moving the pool cleaner in the forward direction until it encounters an upright wall of the pool;

repeating the above steps until the pool cleaner has encountered an upright wall of the pool a predetermined number of times, and then changing the predetermined distance to a different predetermined distance; and repeating the above steps until a substantial area of the floor of the pool has been cleaned by the pool cleaner.

2. The method of claim 1, wherein the predetermined angle varies in a selected number of said turning steps as the floor of the pool is cleaned.

3. The method of claim 1, wherein the pool cleeaner is initially placed proximate to an upright side end wall of the pool.

4. The method of claim 3, wherein the pool cleaner is initially displaced from the side end wall of the pool a distance of from one to three times a width of the robot.

5. The method of claim 1, wherein the predetermined angle is substantially equal to 90°.

6. The method of claim 1, wherein the predetermined angle positions the pool cleaner so that its forward direction of movement is perpendicular to a facing upright wall of the pool.

7. The method of claim 1, wherein the different predetermined distance is greater than the predetermined distance.

8. The method of claim 7, wherein a final change of the predetermined distance provides a different predetermined distance approximately equal to one-half of the distance between two opposing upright side end walls.

9. The method of claim 1, wherein the different predetermined distance is less than the predetermined distance.

10. The method of claim 9, wherein the pool cleaner is initially placed approximately equidistant between two opposing upright side end walls of the pool.

11. The method of claim 1, wherein the pool cleaner turns to the right in said turning step.

12. The method of claim 1, wherein the pool cleaner turns to the left in said turning step.

13. The method of claim 1, wherein the predetermined number of times is seven.

14. The method of claim 1, wherein the difference between each predetermined distance and each different predetermined distance is constant.

15. The method of claim 1, wherein the pool cleaner is propelled in the forward and reverse directions by a single drive motor and includes a rotary impeller driven by the motor in a substantially horizontal plane, said turning step being executed by interrupting the motive force to the impeller for at least one predetermined period during which the motive force is interrupted a plurality of times to impart a sideways directed bias momentum to turn the robot.

16. The method of claim 15, wherein the plurality of times is between 15 and 25.

17. The method of claim 15, wherein the predetermined period lasts for about 10 to 20 seconds.

18. The method of claim 15 wherein each interruption of the motive force lasts for about 0.5 to 0.8 seconds.

19. A method for turning a pool-cleaning robot having a rotary impeller driven in a substantially horizontal plane, the method comprising the step of interrupting the motive force to the impeller for at least one predetermined period of time during which the motive force is interrupted a plurality of times to impart a sideways directed bias momentum for turning the robot.

20. The method of 19, wherein the plurality of times is between 15 and 25.

21. The method of claim 19, wherein the predetermined period of time lasts for about 10 to 20 seconds.

22. The method of claim 19, wherein each interruption of the motive force lasts for about 0.5 to 0.8 seconds.

23. A pool cleaning robot comprising:

a reversible motorized drive capable of propelling the robot along a floor of the pool in a forward direction and of a reverse direction, and of turning the robot;

a wall encounter sensor for providing an encounter signal when the robot reaches an upright wall of the pool;

a controller connected to said drive for propelling the robot in the forward and reverse directions and turning the robot upon receiving command signals; and a processor connected to said controller and said sensor and having stored therein an algorithm for providing the command signals to said controller in response to the encounter signals, such that the robot is moved along the pool floor in a path including:

movement in the forward direction until said sensor provides the proximity signal to said processor, movement in the reverse direction for a predetermined distance from the upright wall, turning the robot through a predetermined angle that is less than 180°, movement in the reverse direction until said sensor provides the proximity signal to said processor, movement in the forward direction until said sensor provides the proximity signal to said processor, repeating the above movements until a predetermined number of proximity signals has been provided, wherein the predetermined distance is changed to a different predetermined distance, and repeating the above movements until a substantial area of the pool floor has been covered by the robot.

24. The robot of claim 23, wherein said sensor comprises a proximity sensor, a collision sensor, a tilt sensor, or a sonar sensor.

25. The robot of claim 23, wherein said drive includes a reversible motorized caterpillar drive.

26. The robot of claim 23, further comprising a GPS receiver for determining the position and direction of movement of the robot.

27. A pool cleaning robot comprising:

a reversible motorized drive capable of propelling the robot along a floor of the pool in a forward direction and a reverse direction;

a rotary impeller driven by said drive in a substantially horizontal plane;

a controller connected to said drive for propelling the robot in the forward and reverse directions and turning the robot upon receiving command signals; and a processor connected to said controller and having stored therein an algorithm for providing the command signals to said controller such the robot is moved along the floor of the pool in a path including:

changing the direction of movement of the robot, and turning the robot by interrupting the motive force to said impeller for at least one predetermined period during which the motive force is interrupted a plurality of times to impart a sideways directed bias momentum to turn the robot.

28. The robot of claim 27, wherein said drive includes a reversible motorized caterpillar drive.

29. The robot of claim 27, further comprising a GPS receiver for determining the position and direction of movement of the robot.

* * * * *